33-241 SR
8/20/85 XR 4,535,544

United States Patent [19]

Jones et al.

[11] Patent Number: 4,535,544

[45] Date of Patent: Aug. 20, 1985

[54] SIGHTING APPARATUS

[76] Inventors: Thomas F. Jones, Rte. 2, Adairsville, Ga. 30103; Jesse L. Morehead, Rte. 1, Rydal, Ga. 30171

[21] Appl. No.: 395,407

[22] Filed: Jul. 6, 1982

[51] Int. Cl.[3] ..... F41G 1/34; F41G 1/46

[52] U.S. Cl. ..... 33/265; 33/241

[58] Field of Search ..... 33/241, 265; 124/87; 362/110

[56] References Cited

U.S. PATENT DOCUMENTS

| | | | |
|---|---|---|---|
| 3,013,336 | 12/1961 | Pennington | 33/265 |
| 3,212,190 | 10/1965 | Larson | 33/265 |
| 3,715,807 | 2/1973 | Heffer | 33/265 |
| 3,945,127 | 3/1976 | Spencer | 33/265 |
| 4,120,096 | 10/1978 | Keller | 33/265 |
| 4,136,462 | 1/1979 | Topel | 33/265 |
| 4,166,324 | 9/1979 | Carollo | 33/241 |
| 4,170,071 | 10/1979 | Mann | 33/265 |
| 4,177,572 | 12/1979 | Hindes | 33/265 |
| 4,179,613 | 12/1979 | Koren | 33/265 |
| 4,195,414 | 4/1980 | Robinson | 33/265 |
| 4,215,484 | 8/1980 | Lauffenburger | 33/265 |
| 4,220,983 | 9/1980 | Schroeder | 33/241 |
| 4,368,581 | 1/1983 | Tullos | 33/265 |

OTHER PUBLICATIONS

Keller Pendulum Bow Sight, Keller Manufacturing Company Brochure.

*Primary Examiner*—Richard R. Stearns
*Attorney, Agent, or Firm*—Jones & Askew

[57] ABSTRACT

An improved pendulous bow sight apparatus for archers, in which a self-adjusting sighting point is aligned with a vertical cross hair to provide a single sighting point that is accurate as to lateral aim and distance. The sighting point is provided by an LED facing the archer, suspended across a pendulously mounted sight assembly and powered by a battery mounted on the sight assembly.

9 Claims, 4 Drawing Figures

SIGHTING APPARATUS

TECHNICAL FIELD

The present invention relates to sighting devices for use with an archery bow, and more particularly, relates to a bow sight which provides automatic and continual sighting.

BACKGROUND OF THE INVENTION

An archery bow has long been recognized as a weapon difficult to fire with consistent accuracy. Conventional firing calls for the archer to sight the target by aiming along the shaft of the arrow. Depending on where the arrow falls in relation to the target, the archer will compensate accordingly. Compensation may be required for such factors as distance, wind, speed or size of the target. Due to the extreme difficulty of making these compensations, the need for a device by which the archer may sight the target has been known for many years.

Various types of bow sight devices are known in the prior art purporting to fulfill this need. One type of known sight provides one or more fixed sighting points to be aligned with the target. In particular, devices have been provided which employ fiber optics or light-emitting diodes (LEDs) as sighting points. Both the LED and the fiber optic sights employ a bead sight or sighting pins providing a series of sighting points to form an illuminated sight pattern. However, the construction of many of these devices obstructs the archer's view of the target, and may require careful attention to determine which sighting point to utilize when the archer's attention is primarily focused on the target. Another problem especially acute when using an archery bow to hunt in little or no light, is that many such illuminated bow sights emit light in the direction of the prey which alerts the prey as to the presence of the archer. A further problem with single bead sight devices in particular, is the lack of means for lateral sighting in relation to the LED.

Another problem in the prior art is facilitating distance compensation. Those devices employing series of horizontal sighting pins facilitate distance sighting but only at discrete intervals. Such devices require that the archer manually adjust the sighting pins to gauge the distance to the target. Again, such a limitation is of critical importance to the hunter. The time spent in adjusting the sighting device may cause the archer to lose an irretrievable opportunity to fire upon the prey. Even should such adjustment of the sighting pins be unnecessary, exact distance sighting is available to the archer only at the location of any particular pin. Thus, should the prey locate at a relative position between two horizontal sighting pins, the archer must revert to approximating the distance variable.

SUMMARY OF THE INVENTION

The present invention solves the above described problems in the prior art by providing a bow sight apparatus that facilitates not only lateral sighting, but also automatic and continual distance sighting, to give the archer the greatest possible assistance in aiming an archery bow.

Generally described, the improved bow sight of the present invention comprises a housing, suitably attached to the bow, which defines an opening therethrough, a thin cross hair extending across the opening, a sight assembly including means for emitting a point of light, and means for suspending the sight assembly for pendulous movement about a horizontal axis within the opening defined by the housing so as to provide for continual distance sighting.

The housing, generally rectangular in shape and formed of brass, aluminum or like conductive material, serves to frame the focus of the archer to the general area of the target. The thin cross hair extending through the opening defined by the housing may comprise a cat gut cross hair. The sight assembly, comprising an LED suspended between two L-shaped vertical plates by two leads electrically connected to a battery, is carried within the opening defined by the housing by two pins aligned on a horizontal axis so as to provide for pendulous movement about the horizontal axis. The visual intersection of the two leads with the cat gut cross hair at the point of the LED provides a self-adjusting sighting point. The battery assembly, which aids the pendulous movement of the sight assembly by weighting the lowermost portion thereof, is carried by the sight assembly below the pivot axis in a battery chamber which extends between the two vertical plates.

The novel construction of the present invention provides continual distance sighting by virtue of the pendulous movement of the sight assembly about the horizontal axis. As the bow is moved up and down to compensate for the distance factor, the point of visual intersection of the two leads with the cross hair at the point of the LED bead sight will move upward or downward depending on the particular adjustment made. When the sighting point is aligned with the target, the proper angle of trajectory of the arrow will be obtained.

Thus, it is an object of the present invention to provide an improved bow sight apparatus.

It is a further object of the present invention to provide a bow sight that automatically compensates for changes in the distance between the bow and a target.

It is a further object of the present invention to provide a bow sight apparatus that facilitates continual distance sighting.

It is a further object of the present invention to provide an illuminated bow sight apparatus that emits light only in the direction of the archer.

It is a further object of the present invention to provide a bow sight apparatus that requires a minimum of manual adjustment.

Other objects, features and advantages of the present invention will become apparatus from reading the following specification when taken in conjunction with the accompanying drawing.

DETAILED DESCRIPTION

Figure 1:
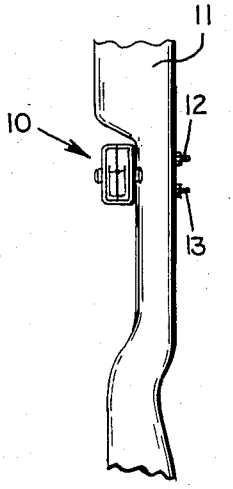
FIG. 1 is a pictorial plan view from the archer's viewpoint of a portion of an archery bow having an embodiment of the bow sight apparatus according to the present invention mounted on it.
Figure 3:
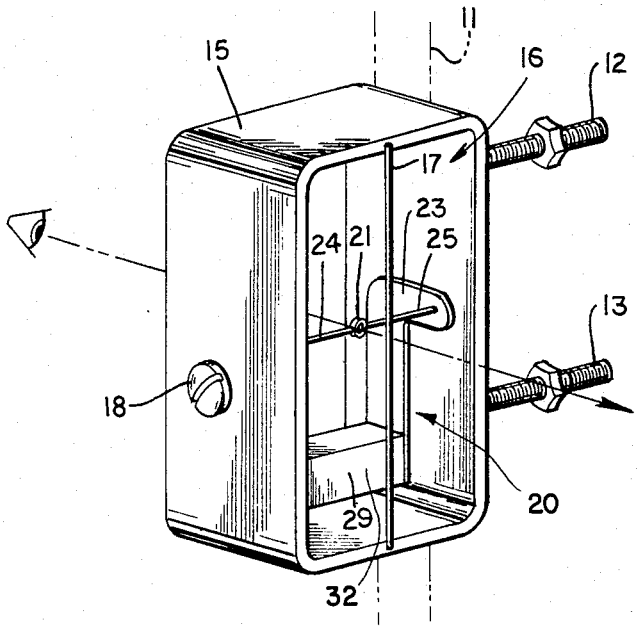
FIG. 3 is a front perspective view of the bow sight apparatus of FIG. 1.
Figure 4:
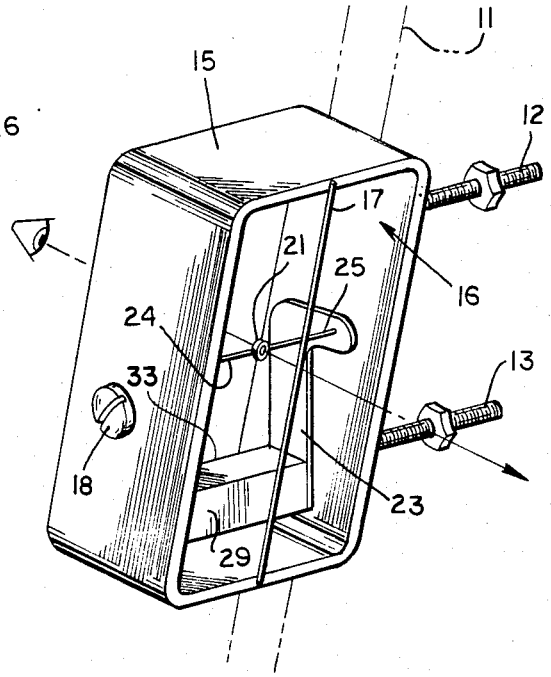
FIG. 4 is a front perspective view of the bow sight apparatus of FIG. 1 aiming lower than as shown in FIG. 3, demonstrating the pendulous movement of the sight assembly.

Referring now in more detail to the drawing, in which like numerals indicate like parts throughout the several views, the preferred embodiment of the bow sight apparatus of the present invention, as shown generally at 10 in FIG. 1, is mounted upon and bolted or otherwise secured to an archery bow 11 by two bolts 12 and 13 (shown generally in FIG. 3 and FIG. 4). Shown for use by an archer who would draw the bow string with his right hand, the details of such mounting are well known in the art. The bolts 12 and 13 pass through a slot (not shown), permitting vertical movement of the entire sight.

Figure 2:
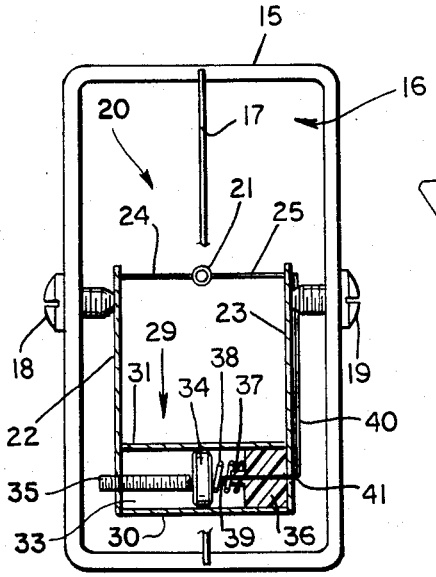
FIG. 2 is a front plan view of the bow sight apparatus of FIG. 1 with a portion of the sight assembly broken away to show interior detail.

As shown in FIGS. 2, 3 and 4, the bow sight 10 includes a housing 15, formed in a generally rectangular shape, defining an opening 16 therethrough in which a sight assembly 20 is carried. The housing 15 may be made of brass, aluminum or any thin, flattened material of suitable strength to house the sight assembly 20. When mounted on the bow 11 as in FIG. 1, the housing 15 not only serves to frame the focus of the archer's eye in the direction of the target, but also provides a means of protecting the sight assembly 20 from the various hazards of rugged field use.

A vertical cross hair 17, which may be comprised of any thin, fibrous-like material such as cat gut string or the like, is secured to the housing 15 and extends across the length of the opening 16. The preferred embodiment shows a single vertical cross hair 17 attached to the housing 15 in an equally spaced apart relation from the vertical walls of the housing 15. Since the primary purpose of the vertical cross hair 17 is to assist the archer in lateral sighting, alternative constructions for suspending the cross hair could, of course, be provided.

The sight assembly 20 is mounted within the opening 16 by two threaded axle members 18 and 19 positioned along a horizontal axis. Thus, the threaded members 18 and 19 define a pivot axis about which the sight assembly 20 pendulously moves. Furthermore, the threaded members 18 and 19 of the preferred embodiment are of a non-conductive material such as nylon, so as to provide a means of electrically insulating the sight assembly 20 from the housing 15.

The sight assembly 20 includes a pair of L-shaped vertical plates 22 and 23, each having a generally horizontal short leg pointing away from the archer and a larger, downwardly extending leg. The threaded members 18 and 19 are tapered to be received within openings in the vertical legs of the plates 22 and 23 located a short distance below the horizontal legs. The sight assembly is suspended above its center of gravity. The plates 22 and 23 are constructed of conductive material such as copper. A light-emitting diode (LED) 21 is suspended between the two L-shaped vertical plates 22 and 23 of the sight assembly 20 by two horizontal electrical leads 24 and 25. One lead 24 is secured to the left vertical plate 22 of the sight assembly at the end of its horizontal leg. The other lead 25 extends through a hole 26 in the right vertical plate 23 and is insulated from plate 23 so as to facilitate electrical connection to a power source. The LED 21 is suspended in such a manner as to place its movement, from the archer's viewpoint, in a vertical plane with the cross hair 17. One skilled in the art will recognize such a construction to be advantageous over prior art LED sighting devices in that the archer may sight along two perpendiculars, the vertical sighting line 17 and the horizontal sighting line created by the two leads 24 and 25. It will be further appreciated by those skilled in the art that the sight mark, the LED 21, is positioned at the visual intersection of the two sighting lines, thereby providing an improved self-adjusting reference point for use in sighting a target. The LED 21 is mounted to emit light only toward the archer, that is, to the left in FIGS. 3 and 4.

As best shown in FIG. 2, the sight assembly further comprises a battery chamber 29 defined by a horizontal base plate 30 extending between and secured to the lowermost portion of the vertical plates 22 and 23, another horizontal plate 31 extending between the two vertical plates 22 and 23 spaced apart from the base plate 30, a front plate 32 and a rear plate 33. The plates 30–33, in combination with the vertical plates 22 and 23, create a housing for the power source to which the LED 21 is electrically connected. A disc-shaped battery 34 is inserted into the battery chamber 29 with its axis parallel to the plates 30–33. A threaded member 35 is threaded through the left vertical plate 22 into the chamber 29. The threaded member 35 may comprise an ordinary set screw. The threaded member 35 extends in a generally horizontal direction to make contact with the negative terminal of the battery 34. The battery 34 is a conventional 1.4 volts watch-type battery and the horizontally extending plates 30 and 31 are positioned in a spaced apart relation slightly greater than the diameter of the battery 34. The end of the battery chamber 29 is filled by a non-conductive plug 36, comprising any non-conductive material such as Nylon. The left side of the plug 36, as seen in FIG. 2, has a horizontally extending projection 37 which is tapered to receive a compression spring 38, the other end of which abuts the battery 34. At the furthermost extending portion of the projection 37 is mounted an electrical contact 39.

It will be understood that the battery chamber 29 can be cylindrical in shape, and can be fabricated from a section of tubing rather than the plates 30–33.

The LED 21 is electrically connected to the contact point 39 by an insulated wire 40 which extends from the lead 25 along the vertical plate 23, through an opening 41 in the plate 23, and through the plug 36 to the contact 39. Thus, it will be seen by those skilled in the art that by rotating the threaded member 35 in a clockwise manner, the battery 34 will move against the pressure of the spring 38 until the positive terminal of the battery 34 engages the contact point 39 so as to illuminate the LED 21. In the preferred embodiment, the sight assembly provides the ground for the LED 21 circuit as the lead 24 is electrically connected to the left vertical plate 22, which is in electrical contact with the set screw 35. Alternative constructions, whereby an insulated ground wire is provided within a pendulous body, could of course be provided.

The battery 34 and associated assembly provide a further unique and novel function by providing a weighted mass to aid the pendulous movement of the sight assembly 20 about the pivot axis created by threaded members 18 and 19. It is important that the distance between the pivot axis and the LED 21 be selected such that raising and lowering of the bow 11 results in movement of the LED 21 that accurately corresponds to changing target distance. This can be done by testing the sight over a range of known distances, and adjusting the location of the pivot axis until the pendulous movement is properly calibrated.

In operation, the bow sight apparatus 10 of the present invention provides an illuminated sighting point that automatically and continually adjusts, in response to the archer's compensations for a variety of factors. By rotation of the threaded member 32, the LED 21 can be turned on and off to provide an inconspicuous light source, capable of extended use, visible only from the archer's point of view.

The novel construction of the pendulous sight assembly 20 provides continual distance sighting of the target. The sight is intially calibrated by loosening the bolts 12 and 13 and adjusting the vertical position of the sight 10 on the bow until the LED 21 sights on a target at a known distance. Then, as the archer moves the bow 11 up or down in relation to the horizon to sight a particular target, the sight assembly 20 will move in a pendulous manner about the horizontal axis of the threaded members 18 and 19. The novel construction of the present invention thus moves the LED 21 up and down along the vertical cross hair 17 so as to maintain the correct sighting point for whatever distance the target may be from the archer. The cross hair 17 cooperates with the LED 21 to provide a vertically and laterally correct sighting point when the LED 21 is aligned with both the target and the cross hair 17.

It should be understood that the foregoing relates only to a preferred embodiment of the present invention and that numerous modifications or alterations may be made therein without departing from the spirit and scope of the invention as set forth in the appended claims.

We claim:

1. An improved bow sight apparatus comprising:

a housing defining an opening therethrough;

a sight assembly including two substantially vertical plate members disposed in parallel spaced apart relation, said sight assembly further comprising means for emitting a point of light suspended between said plate members;

a power source mounted on said sight assembly for supplying electrical energy to said light-emitting means; and means for suspending said sight assembly within said opening defined by said housing for pendulous movement about a horizontal axis spaced apart from said light-emitting means and from the center of gravity of said sight assembly, said power source being mounted below said axis.

2. The apparatus of claim 1 further comprising a vertical sighting cross hair extending across said opening defined by said housing.

3. The apparatus of claim 2 wherein said vertical cross hair lies in a vertical plane which includes the path of movement defined by said point of light as said sight assembly pendulously moves about said horizontal axis; and said light emitting means defines a substantially horizontal sighting element.

4. The apparatus of claim 1 wherein said sight assembly is electrically insulated from said housing.

5. The apparatus of claim 1 wherein said power source comprises a battery.

6. The apparatus of claim 1 wherein said means for emitting light comprises a light-emitting diode suspended in said opening defined by said housing.

7. The apparatus of claim 6 wherein said light-emitting diode is suspended in said sight assembly by two horizontal conductive leads.

8. The apparatus of claim 6 wherein the light-emitting diode is suspended between said plate members of said sight assembly by two leads, a first one of said leads being electrically connected to a first one of said plate members, said first one of said plate members being electrically connected to said power source, and said second one of said leads being electrically connected to said power source.

9. The apparatus of claim 8, further comprising switch means including biasing means for urging said power source out of contact with said second lead; and means for selectively overcoming said biasing means to engage said power source with said second lead.

* * * * *